US008429769B2

(12) United States Patent
Gross

(10) Patent No.: US 8,429,769 B2
(45) Date of Patent: Apr. 30, 2013

(54) SHOWER ARRANGEMENT

(75) Inventor: Juergen Gross, Muehlenbach (DE)

(73) Assignee: Hansgrohe SE, Schiltach (DE)

( * ) Notice: Subject to any disclaimer, the term of this patent is extended or adjusted under 35 U.S.C. 154(b) by 818 days.

(21) Appl. No.: 12/534,391

(22) Filed: Aug. 3, 2009

(65) Prior Publication Data

US 2010/0037389 A1 Feb. 18, 2010

(30) Foreign Application Priority Data

Aug. 15, 2008 (DE) ..... 10 2008 039 797

(51) Int. Cl.
*A47K 3/022* (2006.01)

(52) U.S. Cl.
USPC ..... 4/601

(58) Field of Classification Search ..... 4/601, 570, 4/615, 675
See application file for complete search history.

(56) References Cited

U.S. PATENT DOCUMENTS

| | | | | |
|---|---|---|---|---|
| 2,336,402 | A | 12/1943 | Kaiser | |
| 2,846,691 | A * | 8/1958 | Zettinig | 4/570 |
| 3,564,621 | A | 2/1971 | Fletcher | |
| 3,971,074 | A * | 7/1976 | Yxfeldt | 4/570 |
| 3,982,285 | A | 9/1976 | Roberts, Jr. | |
| 4,572,232 | A | 2/1986 | Gruber | |
| 6,438,767 | B1 | 8/2002 | Warshawsky | |
| 7,748,649 | B2 | 7/2010 | Fujii | |
| 2008/0313802 | A1 | 12/2008 | Heisterhagen | |

FOREIGN PATENT DOCUMENTS

| | | | |
|---|---|---|---|
| DE | 3327829 | A1 | 2/1985 |
| DE | 19649004 | A1 | 5/1998 |
| DE | 20115533 | U1 | 1/2002 |
| DE | 20304879 | U1 | 6/2003 |
| DE | 20319171 | U1 | 2/2004 |
| DE | 102004014126 | B3 | 11/2005 |
| EP | 1690486 | A2 | 8/2006 |
| GB | 2251378 | A | 7/1992 |
| WO | 2005031073 | A1 | 4/2005 |

OTHER PUBLICATIONS

German Patent & Trademark Office, Office Action issued in corresponding German Appln. No. 10 2008 039 797.0, Jan. 26, 2009.
Protest under 37 C.F.R. 1.291, Jan. 23, 2012, Walter Ottesen, Esq.

* cited by examiner

*Primary Examiner* — Huyen Le
(74) *Attorney, Agent, or Firm* — Duane Morris LLP

(57) ABSTRACT

A shower arrangement is proposed which comprises a sanitary fitting designed as a concealed fitting. On the front side of the sanitary fitting is arranged a cover rose. The cover rose has a lateral stub which projects forwardly beyond the front side of the cover rose and is oriented vertically. On the upper side of this stub is mounted a water-conveying wall bar which leads rectilinearly upwards and on whose upper end is mounted an overhead shower head. On the opposite end of the stub is connected a shower hose. The cover rose can be mounted with the stub oriented either on the right or left.

17 Claims, 4 Drawing Sheets

SHOWER ARRANGEMENT

The invention relates to a shower arrangement with a concealed fitting and with a shower which is to be controlled by means of the concealed fitting.

Particularly in old buildings or else when modernizing relatively new buildings, the problem may arise that a shower arrangement should be retrofitted without having to carry out too many structural modifications. In this respect, the space for a concealed fitting is possibly present or can be created. In many cases, a concealed fitting is even present already and may need only to be exchanged.

The object on which the invention is based is to provide a shower arrangement which is particularly intended for retrofitting and which is provided with a concealed fitting.

To achieve this object, the invention proposes a shower arrangement having the features stated in claim 1. Developments of the invention form the subject matter of subclaims.

In this way it is possible not only to use a concealed fitting but also, without having to break open the wall, to find an aesthetic solution as to how a shower head at a distance from the concealed fitting can be supplied with water. The wall bar itself, which may be designed as a conventional wall bar, simultaneously serves for conveying water to the overhead shower head and for constituting a conventional wall bar, with the possibility of attaching objects thereto which are intended to be height-adjustable. These objects include, for example, mirrors, holders for shower additives or the like.

The wall bar may additionally also serve to form the holder for the overhead shower head, i.e. providing not only a possibility of attaching an overhead shower head thereto but also of forming the overhead shower head as a closure and terminal element of the wall bar. Of course, provision may be made in particular to angle or bend the wall bar in its end region into the room so as also to arrange the overhead shower head at a horizontal distance from the wall.

To reinforce the impression of the conventional wall bar, provision may be made in a development for the wall bar, starting from its connection with the concealed fitting, to have a rectilinear design such that its connection with the concealed fitting is arranged outside the wall. The wall bar virtually grows upwardly out of the concealed fitting.

According to the invention, the wall bar may be designed in such a way that it rests directly on the wall surface. It may also be fastened to this wall surface. However, according to the invention, provision may also be made in a development to arrange the wall bar at a distance in front of the wall, in particular at such a distance as to allow not only easy cleaning behind the wall bar but also to mount holders which can be rotated around the wall bar. It should thus also be possible for objects to be rotated to the side. A fastening element can then be provided in the upper region in order to obtain a connection with the wall.

To obtain a hydraulic connection between the concealed fitting, which is not specifically tailored to the wall bar, and the wall bar, there may be provided an adapter element which produces this connection. Provision may be made in particular for the adapter element to be contained at least in part in a cover rose of the concealed fitting. This cover rose may be designed in such a way that it visually forms a connection with the wall bar, in particular is tailored thereto.

The adapter element here is guided through the cover rose.

In a further development of the invention, provision may be made for the shower arrangement to comprise a device for angularly aligning the wall bar with respect to the concealed fitting. Since the wall bar up to the overhead shower head has a considerable length, an angular error in the alignment of the rose that cannot be detected at the rear side with the naked eye can nevertheless be detected at the wall bar. To avoid such an unsightly misalignment, the invention proposes this aligning device.

In particular, the adapter element which produces the hydraulic connection may be designed in such a way that this alignment is nevertheless permitted. There are various possibilities for this purpose. In one option, a line piece between the output of the sanitary fitting and the wall bar may be arranged in the adapter element or in the rose, this line piece allowing length compensation and/or angle compensation. For length compensation, two pipe sections may be fitted telescopically one inside the other. For angle compensation, one end of the line may be inserted into a bore which can be rotated with respect to this end.

Also possible is the use of a deformable line piece, for example a hose.

In a shower arrangement which is particularly suitable for retrofitting or subsequent attachment, provision may be made in a development for the shower arrangement also to comprise a connection for a shower hose. This is particularly applicable because it is of course also possible then for a holder for a hand shower head to be mounted on the wall bar which is present in any case.

It has proved to be particularly expedient that the connection for a shower hose is arranged outside the wall accommodating the concealed fitting and, in particular, also runs parallel to the wall surface. It is to be preferred for visual reasons if the connection for the shower hose points in an opposite direction to the wall bar.

In a further development of the invention, provision may be made for the connection for the shower hose to be arranged in a rectilinear continuation of the wall bar.

For reasons of simple operation and a low space requirement, according to the invention provision may be made in a development for the wall bar and/or the connection for the shower hose to be arranged laterally on the concealed fitting.

Since an angular alignment is also expedient when using a connection for a shower hose, provision may also be made for an adapter element to be present between the connection for the shower hose and the sanitary fitting, this adapter element likewise being expediently arranged in the rose and leading therethrough.

It has already been mentioned that it is expedient if both the connection for the wall bar and the connection for the shower hose are arranged laterally on the fitting. According to the invention, provision may now be made in a development for the adapter element to be designed, between the sanitary fitting and the wall bar or between the sanitary fitting and the connection for the shower hose, in such a way that the wall bar and/or the connection for the shower hose can be mounted laterally on the fitting either on the right or left. It can therefore still be decided during installation where exactly the wall bar should be. To make this possible in a particularly simple manner, provision may be made in a development for the connection for the wall bar and the connection for the shower hose to have an identical design. In this case, the adapter need only to be turned around.

Further features, details and advantages of the invention will become apparent from the claims and the abstract, the wording of both being incorporated in the description by reference, from the following description of preferred embodiments of the invention and with reference to the drawing, in which:

Figure 1:
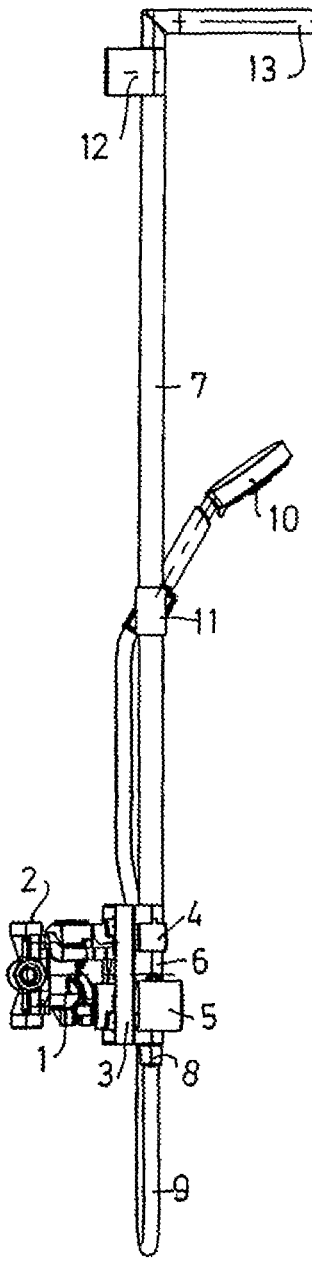
FIG. 1 shows a side view of a shower arrangement according to the invention.

FIG. 1 shows the side view of the shower arrangement proposed by the invention, as it would be arranged in front of or in a wall. The shower arrangement comprises a conventional sanitary fitting 1, with connections 2 for a domestic plumbing system. The sanitary fitting is intended to be fitted in a wall. On the front side of the sanitary fitting 1 is arranged a cover rose 3 whose rear side is intended for bearing against the front side of the wall outside of the recess in which the sanitary fitting 1 is installed. Engaging through the cover rose 3 are actuating elements which are actuated by two rotary knobs 4, 5 mounted on the front side. A pipe stub 6 is then also additionally arranged on the front side of the cover rose 3, a wall bar 7 being mounted on the upper side of this stub. On the opposite lower side of the cover rose 3, there is a connection 8 for a shower hose 9. The shower hose 9 hangs down freely, and its other end is provided with a hand shower head 10 which is fixed in a holder 11. The holder 11 is mounted on the wall bar 7 and can be displaced vertically thereon. Since the pipe stub 6 and the wall bar 7 are mounted in front of the front side of the cover rose 3, space still remains between the rear side of the wall bar 7 and the wall surface.

In its upper region, the wall bar 7, which extends rectilinearly, is provided with a wall holder 12 which can be screwed onto the wall and thereby fixes the wall bar 7. Above the wall holder 12, the wall bar 7 is bent at a right angle and thereby forms a branch 13 which extends horizontally. A shower head 14 of an overhead shower is mounted on the end of the branch 13 of the wall bar 7. The wall bar 7 is hollow, and it serves not only to fasten the overhead shower head 14 but also to supply it with water.

Figure 2:
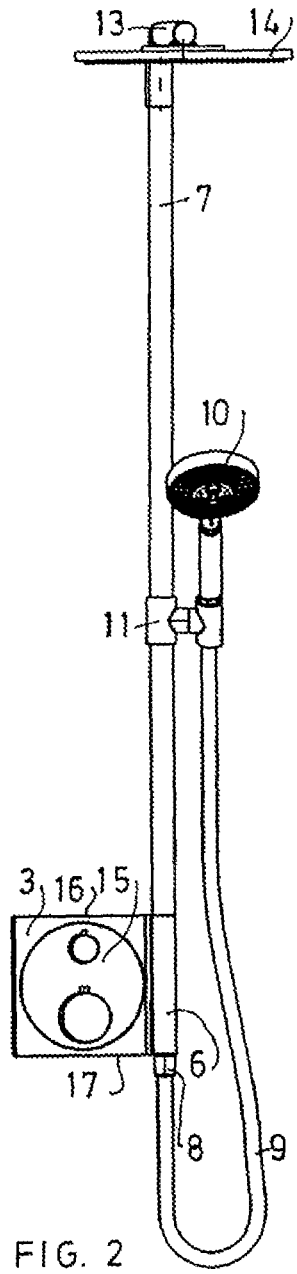
FIG. 2 shows the view of the arrangement in FIG. 1 from the right in FIG. 1.

FIG. 2 shows a front view of the shower arrangement in FIG. 1, that is to say from the right in FIG. 1. The cover rose 3 is square, with the pipe stub 6 mounted on the right, this stub being offset forwardly with respect to the front side of the cover rose 3. A cover 15 which is circular is arranged centrally in relation to the square cover rose 3. The sanitary fitting can be actuated through this cover 15 by means of the two rotary knobs 4, 5. The pipe stub 6 has a length such that, both at its upper and at its lower end, it extends flush with the upper edge 16 and the lower edge 17, respectively, of the cover rose 3.

It can be seen at the upper end that the branch 13 of the wall bar 7, although extending at a right angle with respect to the vertical part of the wall bar 7, does not extend perpendicularly with respect to the surface of the wall. The mid-point of the overhead shower head 14 is intended to be offset laterally to some extent.

Figure 3:
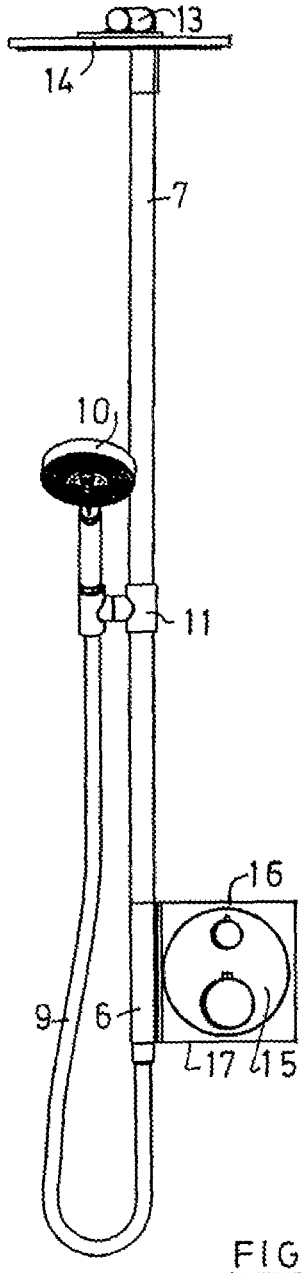
FIG. 3 shows a representation corresponding to FIG. 2 with a modified arrangement of the wall bar.

FIG. 3 shows that the arrangement of the stub 6 laterally on the cover rose 3 can also be produced differently, namely directly on the other side. This can be achieved by removing the cover rose 3 and refastening it in a turned-round state. The connection point for the shower hose, which is towards the bottom in the arrangement of FIG. 2, therefore is moved towards the top, and the connection point for the wall bar 7 is moved towards the bottom. This possibility is achieved as a result of the two connections having an identical design.

Figure 4:
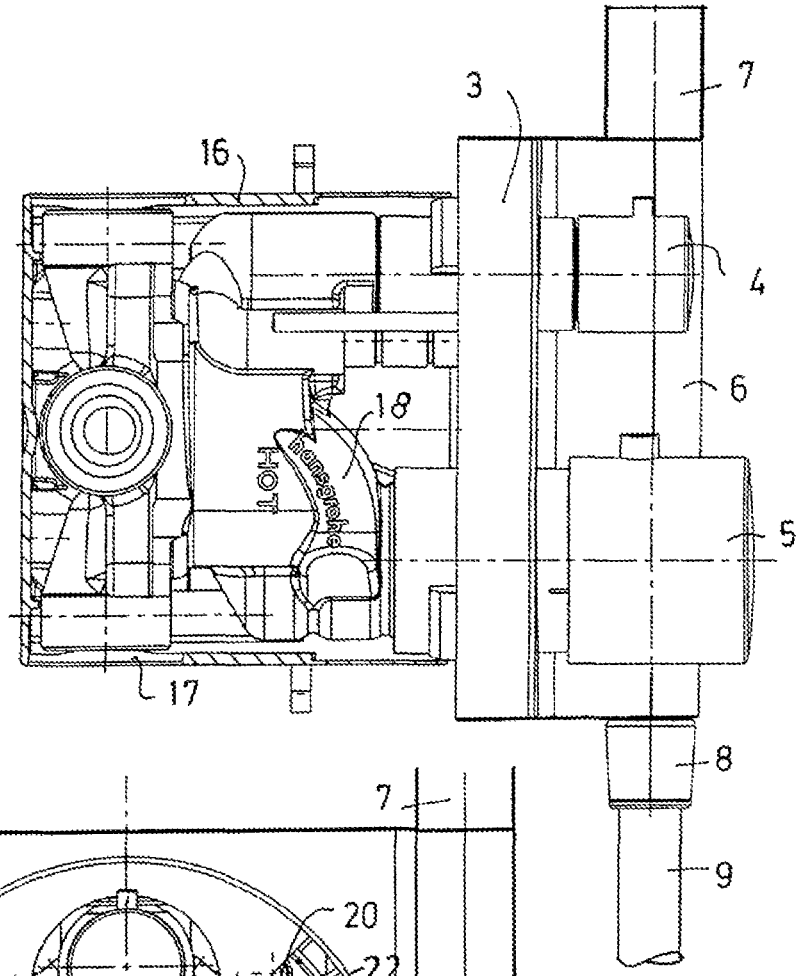
FIG. 4 shows a side view of the sanitary fitting on an enlarged scale.

FIG. 4 shows, on an enlarged scale, the side view of the sanitary fitting 1, in the same representation as in FIG. 1, but this time within a concealed box 16. The concealed box 16 is shown in section. The sanitary fitting 1 is fastened within the concealed box 16 in such a way that the line connections to the sanitary fitting 1 engage through openings 17 in the side walls of the concealed box 16. The sanitary fitting 1 is thus fixed in the concealed box 16. As has already been mentioned, the rear side of the cover rose 3 in the fitted state is intended to bear against the surface of the wall. The wall bar 7, like the connection 8 for the shower hose 9, is still at a distance with respect to the front side of the cover rose 3.

A line piece 18, shown in partial section, leads from the front side of the sanitary fitting 1 through the cover rose 3 to the wall bar 7 and the shower connection 8. This is more clearly visible in the representation in FIG. 5.

The sanitary fitting 1 is provided at its front side with two connections 19, 20 which are controlled by the sanitary fitting. Each of the two connections 19, 20 has a respective line piece 18 and 21 leading therefrom in an angled manner to the stub 6. One of the two line pieces, namely the lower line piece 18 in FIG. 5, leads inside the cover rose to the connection 8 for the shower hose, while the other line piece 21 leads to the wall bar 7. Both line pieces 18, 21 contain two component elements which are fitted one inside the other so as to allow length compensation. The line pieces 18, 21 are pivotally mounted in the connections 19, 20.

Figure 5:
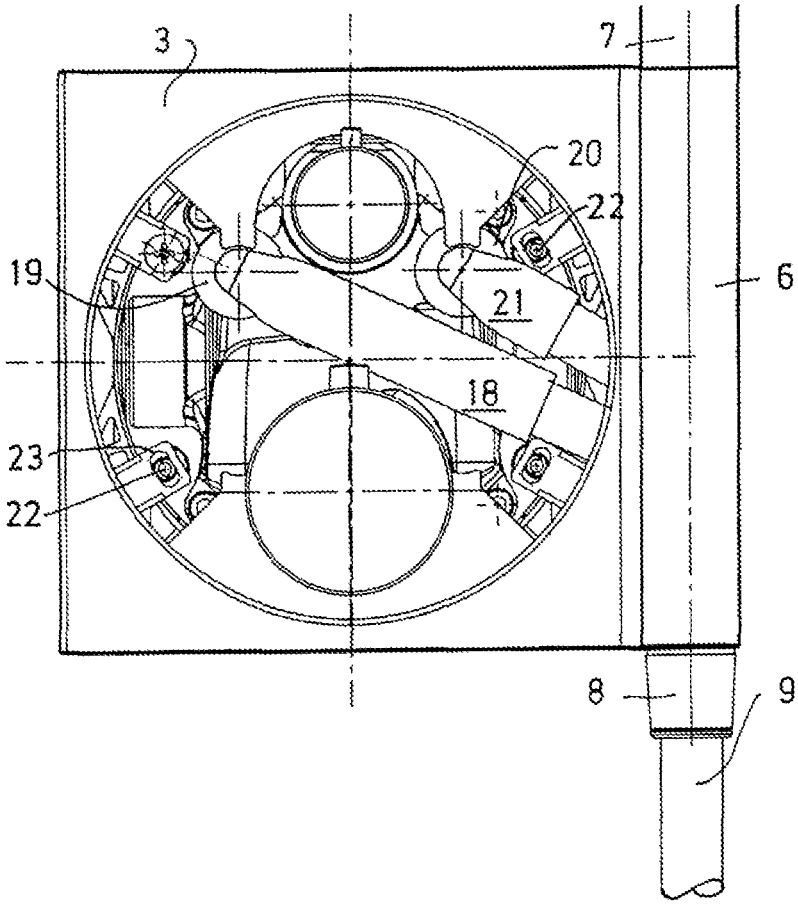
FIG. 5 shows a cross section through the arrangement in FIG. 4.

FIG. 5 shows the front view of the arrangement with the cover 15 removed. If the stub 6 is intended to be placed on the other side, this can take place by loosening the screws 22. These screws 22 engage through oblong holes 23 in lugs of the cover rose 3. This also makes it possible to achieve an angular alignment of the cover rose 3 with respect to the fixed concealed box 16 and the sanitary fitting 1 contained therein. This variation in alignment is made possible by the fact that the line pieces 18, 21 permit length compensation.

Figure 6:
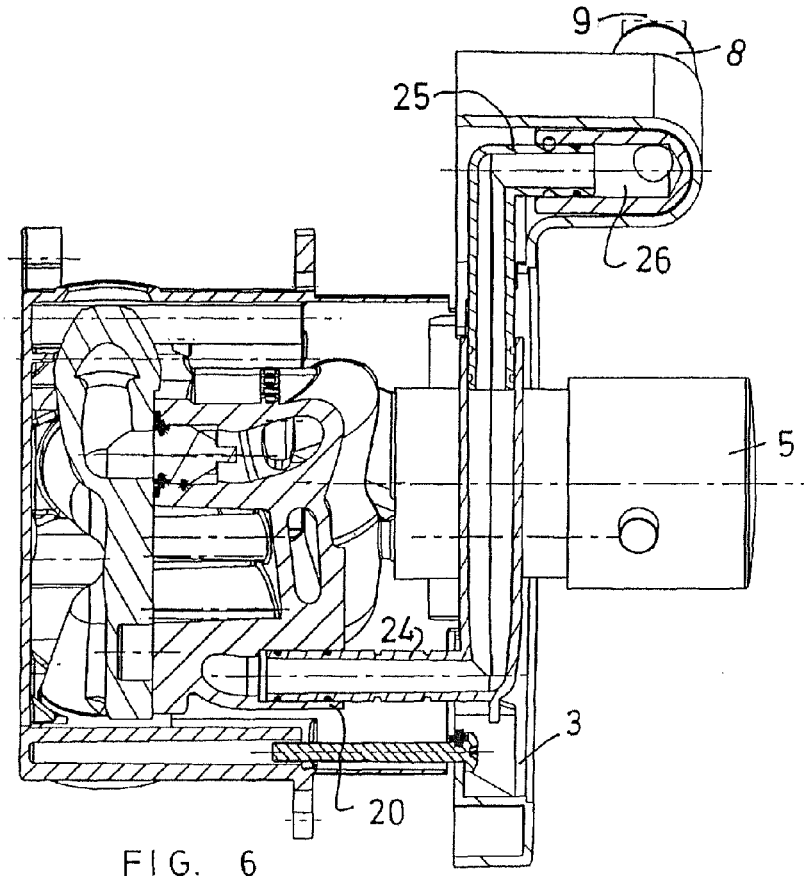
FIG. 6 shows a section through the sanitary fitting.

FIG. 6 shows a section through the sanitary fitting and the concealed box 16 in another plane than the section plane in FIG. 4. Here can be seen one branch 24 of the line piece 18 that engages in the connection 19 of the sanitary fitting. Extending perpendicularly to this portion 24 is the front portion, which can also be seen in front view in FIG. 5. The second part of the line piece 18 engages in this portion, thus resulting here in telescopic guiding which allows length compensation. This second part of the line piece 18 also has a branch 25 which is bent off at a right angle and which engages in a receptacle 26. The receptacle 26 is connected to the interior of the stub 6. In this way there is produced a line connection between the sanitary fitting 1 and the connection 8 for the shower hose 9. A connection between the sanitary fitting and the wall bar 7 is also achieved in the same manner.

Figure 7:
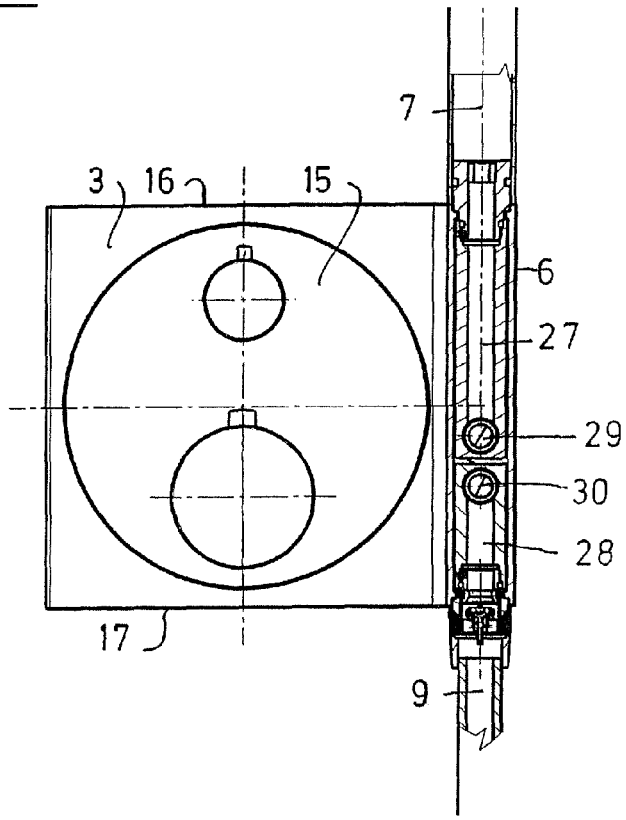
FIG. 7 shows a further section through part of the sanitary fitting.

FIG. 7 now shows another section through the connection stub 6 in a plane parallel to the wall surface. The stub 6 has a blind bore 27, 28 respectively emanating from its upper side and its lower side. The two blind bores 27, 28 are thus separated from one another by a dividing wall. A duct 29, 30, which is connected to the end of a line piece 18, 21, opens into the respective blind bore 27 and 28 perpendicularly to the axis of the stub 6.

The actual connections for the wall bar 7 and the shower hose 9 are designed to be identical, which means that their roles can be reversed.

Figure 8:
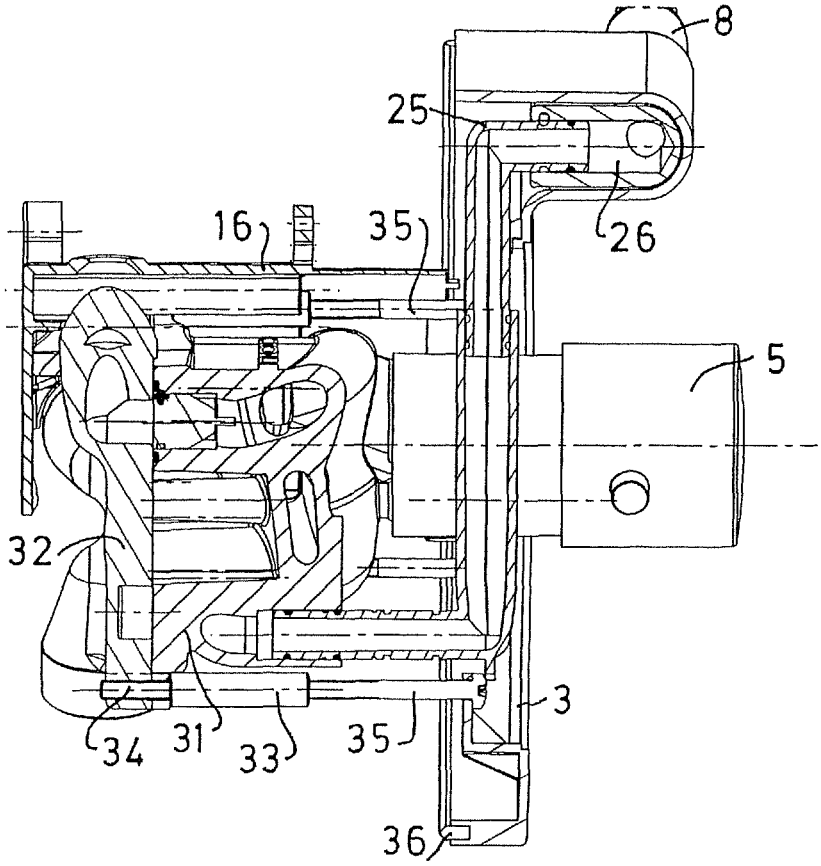
FIG. 8 shows a section corresponding to FIG. 6 through a modified embodiment.

Whereas in the embodiment shown in FIG. 5 the cover rose 3 is fastened to the concealed box 16 by means of screws, FIG. 8 shows an embodiment having a different type of fastening.

To fix the fitting housing 31 to the base part 32, use is made of screws 33 which have an extended screw head which is provided with a threaded bore on its side facing away from the threaded shank 34. The fastening screw 35 for the cover rose 3 is then screwed into this threaded bore in the screw head. This applies to all fastening screws 35. Apart from the mounting having a greater degree of stability, this type of mounting offers the advantage that the rose 3 is fastened to the fitting, which is acoustically uncoupled with respect to the wall-connected concealed box 16 in the lead-throughs for the lines.

A foam rubber seal 36 is arranged in a groove on the rear side of the cover rose 3 and is intended for uncoupling and isolating the cover rose 3 with respect to the wall.

The invention claimed is:

1. Shower arrangement comprising a concealed fitting, the concealed fitting having a particular alignment as mounted in a wall, a water-conveying wall bar which is mechanically and hydraulically connected to the concealed fitting and which is configured to be arranged outside the wall containing the concealed fitting, further comprising an overhead shower head mounted on the wall bar and supplied through the wall bar with water, further comprising an adapter element between the concealed fitting and the wall bar, wherein the adapter element is designed in such a way that the adapter element allows the wall bar to be angularly aligned with respect to the alignment of the concealed fitting.

2. Shower arrangement according to claim 1, wherein the overhead shower head is mounted on an end of the wall bar that projects away from the wall.

3. Shower arrangement according to claim 1, wherein, starting from a connection of the wall bar with the concealed fitting, the wall bar has a rectilinear design such that the connection with the concealed fitting is arranged outside the wall.

4. Shower arrangement according to claim 1, wherein the wall bar is arranged at a distance in front of the wall.

5. Shower arrangement according to claim 1, wherein the adapter element is contained at least in part in a cover rose of the concealed fitting.

6. Shower arrangement according to claim 1, wherein the adapter element is guided through a cover rose of the concealed fitting.

7. Shower arrangement according to claim 1, wherein the adapter element comprises a line piece at one of a location between the sanitary fitting and the wall bar and a location between the sanitary fitting and a connection, and wherein the line piece is arranged for at least one of length compensation and angle compensation.

8. Shower arrangement according to claim 7, wherein the line piece is deformable.

9. Shower arrangement according to claim 1, further comprising a connection for a shower hose.

10. Shower arrangement according to claim 9, wherein the connection for the shower hose is arranged outside the wall accommodating the concealed fitting and runs parallel to the wall surface.

11. Shower arrangement according to claim 9, wherein the connection for the shower hose points in an opposite direction to the wall bar.

12. Shower arrangement according to claim 9, wherein the connection for the shower hose is arranged in a rectilinear continuation of the wall bar.

13. Shower arrangement according to claim 9, wherein at least one of the wall bar and the connection for the shower hose is arranged laterally on the concealed fitting.

14. Shower arrangement according to claim 9, comprising an adapter element between the concealed fitting and the connection for the shower hose.

15. Shower arrangement according to claim 14, wherein the adapter element is designed, at one of a location between the sanitary fitting and the wall bar and a location between the sanitary fitting and the connection for the shower hose, in such a way that at least one of the wall bar and the connection for the shower hose is mountable laterally on the fitting either on the right or left.

16. Shower arrangement, comprising:

a concealed fitting, a water-conveying wall bar which is mechanically and hydraulically connected to the concealed fitting and which is configured to be arranged outside a wall containing the concealed fitting, an overhead shower head mounted on the wall bar and supplied through the wall bar with water, an adapter element between the concealed fitting and the wall bar, wherein the adapter element is designed in such a way that the adapter element allows the wall bar to be angularly aligned with respect to the concealed fitting, wherein the adapter element comprises a line piece at one of a location between the sanitary fitting and the wall bar and a location between the sanitary fitting and a connection, and wherein the line piece is arranged for at least one of length compensation and angle compensation, and wherein the line piece is fixed in the cover rose.

17. Shower arrangement, comprising:

a concealed fitting, a water-conveying wall bar which is mechanically and hydraulically connected to the concealed fitting and which is configured to be arranged outside a wall containing the concealed fitting, an overhead shower head mounted on the wall bar and supplied through the wall bar with water, an adapter element between the concealed fitting and the wall bar, wherein the adapter element is designed in such a way that the adapter element allows the wall bar to be angularly aligned with respect to the concealed fitting, a connection for a shower hose, and, wherein the connection for the wall bar and the connection for the shower hose have an identical design.

* * * * *